US005631083A

United States Patent [19]

Pinoca et al.

[11] Patent Number: 5,631,083

[45] Date of Patent: May 20, 1997

[54] FIBERS SUITABLE FOR THE PRODUCTION OF NONWOVEN FABRICS HAVING IMPROVED STRENGTH AND SOFTNESS CHARACTERISTICS

[75] Inventors: Leonardo Pinoca, Narni; Renato Africano, Ferrara; Leonardo Spagnoli, Terni, all of Italy

[73] Assignee: Montell North America Inc., Wilmington, Del.

[21] Appl. No.: 259,318

[22] Filed: Jun. 13, 1994

[30] Foreign Application Priority Data

Jun. 17, 1993 [IT] Italy ..... MI93A1310

[51] Int. Cl.[6] ..... D02C 3/00

[52] U.S. Cl. ..... 428/365; 428/370; 428/397; 428/401; 428/357; 264/210.8; 264/171.28; 156/178; 156/167; 442/361

[58] Field of Search ..... 428/288, 296, 428/357, 365, 397, 401, 364, 212, 370, 286, 340; 156/148, 178, 308.2, 86, 181, 167; 264/210.7, 210.8, 210.2, 171, 524, 248

[56] References Cited

U.S. PATENT DOCUMENTS

| | | | |
|---|---|---|---|
| 4,469,540 | 9/1984 | Furukawa et al. | 156/62.4 |
| 4,770,925 | 9/1988 | Uchikawa et al. | 428/219 |
| 4,874,666 | 10/1989 | Kubo et al. | 428/398 |
| 5,078,935 | 1/1992 | Kubayashi et al. | 264/103 |
| 5,227,224 | 7/1993 | Ishikawa et al. | 428/212 |

FOREIGN PATENT DOCUMENTS

| | | |
|---|---|---|
| 391438 | 10/1990 | European Pat. Off. . |
| 552810 | 7/1993 | European Pat. Off. . |

OTHER PUBLICATIONS

U.S. Serial No. 07/968,766, filed Oct. 30, 1992 now U.S. Pat. No. 5,346,756, issue date Sep. 13, 1994.

U.S. Serial No. 08/259,316, filed Jun. 13, 1994.

*Primary Examiner*—Merrick Dixon

[57] ABSTRACT

Disclosed is a drawn, polyolefin fiber useful for nonwoven fabrics, the thermobonding index of said fiber being 4.5–9 Newtons, and the flexibility index thereof being 1020–1500. The fiber is composed of a blend of specified polymers. Also disclosed is a process for making the fiber by spinning the blend from a die hole having at the output end a diameter less than 0.5 mm, and drawing the resulting fiber at a draw ratio of 1.1 to 1.8.

9 Claims, No Drawings

FIBERS SUITABLE FOR THE PRODUCTION OF NONWOVEN FABRICS HAVING IMPROVED STRENGTH AND SOFTNESS CHARACTERISTICS

The present invention relates to nonwoven fabrics prepared by thermobonding which display improved strength and softness characteristics, and the process for producing them. More particularly, the present invention relates to staple fibers produced by a continuous or discontinuous spinning and drawing process, using polymer materials which comprise heterophasic polyolefin compositions, possessing good flexibility and thermobonding strength.

The definition of "fibers" includes also products similar to fibers, such as fibrils.

Nonwoven fabrics are widely used in various applications, and for some of these applications the softness and strength of the nonwoven fabrics are particularly desired and requested. For example, in the health and medical fields, where these products are used for sanitary napkins, bandages, gowns, etc., softness is very important because the product comes in contact with the skin. Other fields include, for example, the wrapping and packaging of either fragile or easily damageable objects, where the material must not only be soft but also strong in order to help prevent breakage.

Polyolefin fibers used for the preparation of nonwoven materials are already known in the art, said fibers being optionally prepared with a heterophasic polymer and possessing thermobonding properties. For example, fibers with the above mentioned properties are described in published European patent application EP-A-391438. In said patent application the fibers prepared in the examples comprise only propylene homopolymer, or ethylene/propylene copolymer having a thermobonding strength, measured with the method described below, of up to 4 Newton ("N").

Another example of polyolefin fibers containing heterophasic polyolefin compositions is given in published European patent application EP-A-0 552 810. Said patent application describes fibers produced from blends comprising up to 30% of a rubber fraction.

The heterophasic polyolefin compositions described in the '810 application are suitable for the preparation of fibers having thermoshrinking characteristics. Said fibers, which have a high count value (the values, mentioned only in the examples, range from 15 to 19 dtex), can be used to produce tufted carpets. However, said patent application does not refer to other uses and properties of the fibers, i.e., there is no mention of which compositions are suitable for the production of fibers having good thermobonding and flexibility properties, nor are the spinning parameters given which would allow one to obtain said results.

One embodiment of this invention comprises polyolefin fibers which offer high thermobonding indexes, preferably from 4.5 to 9 N, more preferably from 6 to 9 N, and flexibility indexes preferably ranging from 1020 to 1500. Said properties allow one to obtain nonwoven fabrics having good strength and softness properties.

A further embodiment of the present invention relates to the process for the preparation of nonwoven fabrics which comprise said fibers and offer both strength and softness properties.

Another embodiment of the present invention relates to the process used to prepare said fibers.

Yet another embodiment of the present invention concerns the nonwoven fabrics obtained by said process.

Accordingly, the present invention provides a fiber for nonwoven fabrics, which fiber comprises a polymer material containing (by weight):

1) from 50 to 80 parts of a propylene homopolymer having an isotactic index greater than 90, or a random copolymer thereof with ethylene and/or a $C_4$–$C_8$ α-olefin; and 2) from 20 to 50 parts of a heterophasic polymer comprising:

a) from 20 to 70 parts of a propylene homopolymer and/or a random copolymer of propylene with ethylene and/or with a $C_4$–$C_8$ α-olefin, containing from 0.5 to 10% of ethylene and/or $C_4$–$C_8$ α-olefin (Fraction I); and b) from 30 to 80 parts of a copolymer of ethylene with propylene and/or a $C_4$–$C_8$ α-olefin soluble in xylene at 25° C., said copolymer containing from 40 to 70% of ethylene, and having an intrinsic viscosity lower than or equal to 1.5 dl/g, or said copolymer containing less than 40% of ethylene and having an intrinsic viscosity lower than or equal to 2.3 dl/g (Fraction II);

said fiber being obtained by spinning the above mentioned polymer material and then drawing it out with a draw-ratio from 1.1 to 1.8, preferably from 1.1 to 1.5.

The $C_4$–$C_8$ α-olefins to be used for the preparation of the copolymers of subparagraph 1) above and Fractions I and II are linear or branched alkenes, and they are preferably selected from 1-butene, 1-pentene, 1-hexene, 1-octene and 4-methyl-1-pentene. The preferred α-olefin is the 1-butene.

The random copolymer of subparagraph 1) above contains a quantity of comonomer preferably ranging from 0.05 to 15% by weight.

The heterophasic polymer is present in the polymer material preferably in an amount ranging from 20 to 45 parts by weight.

Fraction I is present in the heterophasic polymer preferably in an amount ranging from 30 to 65 parts by weight, while Fraction II preferably in an amount from 35 to 70 parts, by weight.

The heterophasic polyolefin compositions can be prepared either by mechanically blending Fractions I and II in the molten state, or using a sequential polymerization process carried out in two or more stages, and using stereospecific Ziegler-Natta catalysts. The heterophasic polymer obtained in the latter case comprises also a third fraction, which is an essentially linear crystalline ethylene copolymer insoluble in xylene at ambient temperature. This fraction is present in an amount ranging from 2 to 40 parts by weight, preferably from 2 to 20, of the total heterophasic polymer.

Examples of the above mentioned heterophasic polyolefin compositions, as well as the catalysts and polymerization processes used for their preparation, can be found in published European patent applications 400333 and 472946.

The intrinsic viscosity values of Fraction II, within the limits indicated by the present invention, are obtained either directly in polymerization, or after the polymerization by means, for example, of a process of controlled radical visbreaking, or by other means (thermal degradation, for example). The above mentioned process is carried out by using organic peroxides, for example, such as 2,5-dimethyl-2,5-di(tert-butylperoxy)hexane. The compounds used for the degradation of the polymer chains are added by themselves or together with other additives (such as UV stabilizers, flame retardants, etc.) to the heterophasic polymer to be degraded during the extrusion step, as an example.

The heterophasic polymer thus obtained is blended with the proper quantities of a crystalline polymer of subparagraph 1) above; the resulting polymer blend is then subjected to spinning according to known techniques and under the operating conditions indicated below. As a way of example, one can use a die with a real or equivalent output hole diameter of less than 0.5 mm. and a hole length/diameter ratio from 3.5 to 5, operating at temperatures from 250° to 320° C. and at an air speed from 0.1 to 0.6 m/sec. The fiber obtained preferably has a count of from 1 to 4 dtex.

The real or equivalent output hole diameter is preferably from 0.2 to 0.45 mm for fibers having a count of less than 4 dtex. The ratio between said output hole diameter and the count is or less than 0.06 mm/dtex, preferably less than or equal to 0.05 mm/dtex, for fibers having count equal to or higher than 4 dtex.

By "output diameter of the holes" is meant the diameter of the holes measured at the external surface of the die, i.e. on the front face of the die from which the fibers exit. Inside the thickness of the die, the diameter of the holes can be different from the one at the output. Moreover, the "equivalent output diameter" definition applies to those cases where the hole shape is not circular. In these cases, for the purposes of the present invention, one considers the diameter of an ideal circle having an area equal to the area of the output hole, which corresponds to the above mentioned equivalent diameter.

One can add peroxides or other additives to the fibers, such as for example dies, opacifiers and fillers, even during spinning.

Tests were conducted on the polymer material and fibers of the present invention to evaluate their characteristics and properties; the methods used for said tests are described below.

Melt Flow Rate (MFR): according to ASTM-D 1238, condition L.

Weight average molecular weight ($\overline{M}w$): GPC (Gel Permeation Chromatography) in ortho-dichlorobenzol at 150° C.

Number average molecular weight ($\overline{M}n$): GPC (Gel Permeation Chromatography) in ortho-dichlorobenzol at 150° C.

Intrinsic viscosity:

1 g of polymer is dissolved in a flask in 100 ml of xylene. The solution, in nitrogen atmosphere, is heated to 135° C. for 30 minutes. Then, while under agitation, the solution is cooled first to 90° C., and then to 25° C. by submerging the flask in water. The solution is allowed to rest at that temperature for 30 minutes. Then it is filtered with paper, and acetone in excess and methanol are added to the filtered solution. The precipitate thus obtained is separated with a G4 filter, then dried and weighed. Finally the intrinsic viscosity is measured on a portion of the precipitate using the tetrahydronaphtalene method at 135° C.

Thermobonding strength: in order to evaluate the thermobonding of staple fibers, a nonwoven fabric is prepared with the fiber being tested by way of calendering under set conditions. Then one measures the strength needed to tear said nonwoven fabric when the stress is applied in directions which are both parallel and transversal to that of the calendering.

The thermobonding index (TBI) is defined as follows:

$$TBI=(TM\cdot TC)^{1/2}$$

where TM and TC represent the tear strength of the nonwoven fabric measured according to ASTM 1682, for the parallel and transversal directions respectively, and expressed in Newtons.

The value of the strength determined in this fashion is considered a measure of the capability of the fibers to be thermobonded.

The result obtained, however, is influenced substantially by the characteristics regarding the finishing of the fibers (crimping, surface finishing, thermosetting, etc.), and the conditions under which the card web fed to the calender is prepared. To avoid these inconveniences and obtain a more direct evaluation of the thermobonding characteristics of the fibers, a method has been perfected which will be described below in detail.

Specimens are prepared from a 400 tex roving (method ASTM D 1577-7) 0.4 meter long, made up of continuous fibers.

After the roving is twisted eighty times, the two extremities are united, thus obtaining a product where the two halves of the roving are entwined as in a rope. On said specimen one produces one or more thermobonded areas by means of a thermobonding machine commonly used in a laboratory to test the thermobonding of film.

A dynamometer is used to measure the average strength required to separate the two halves of the roving at each thermobonded area. The result, expressed in Newtons ("N"), is obtained by averaging out at least eight measurements. The welding machine used is the Brugger HSC-ETK. The clamping force of the welding plates is 800 N; the clamping time is 1 second, and the temperature of the plates is 150° C.

Bonding is also tested at various temperatures around 150° C. in order to pinpoint at which temperature one can obtain a bonding capability equal to the one for the propylene homopolymer fibers at 150° C.

Flexibility index

The softness is evaluated by way of an index which represents the flexibility of the fiber. Said index is defined in the following manner:

$$FI=(1/W)\cdot 100$$

where W is the minimum quantity in grams of a specimen which when tested with the Clarks Softness-Stiffness Tester changes the direction of the flexion when the plane, on which the specimen is fixed in a perpendicular position, rotates alternatively +/−45° with respect to the horizontal plane.

The specimen has the same characteristics as the one used to measure thermobonding strength and is prepared using the same process described above.

Spinnability test

The polymer material blends are spun on a Leonard 25 spinning apparatus at the following spinning conditions:

temperature: 290° C.;

number of holes in the die: 61;

diameter of the holes: 0.4 mm;

length of the holes: 2 mm;

hole flow-rate: 0.3 g/min;

fiber quenching: lateral air flow with temperatures ranging from 18° to 20° C. and speed at 0.45 m/sec.

The extruded filaments are then wound on a bobbin by one of the following winding machines:

Leesona 967, which gathers and winds at a speed ranging from 150 to 1250 m/min.;

Cognesint GRC T661, which gathers and winds at a speed ranging from 1250 to 5500 m/min.

The following examples are given in order to illustrate and not limit the present invention.

A) Preparation of the polypropylene resin

In a LABO-30 Caccia turbo-mixer, operating at 1400 rpm, the following products are blended for 4 minutes:

1) flake polypropylene with controlled particle size;

2) 200 ppm of poly{[6-(1,1,3,3-tetramethylpiperidyl)-imine]-1,3,5-triazine-2,4-diyl][2-2,2,6,6-tetramethylpiperidyl)-amine]hexamethylene-[4-(2,2,6,6-tetramethylpiperidyl) imine]} (Chimassorb 944, marketed by CIBA-GEIGY); and 3) 350 ppm g of tris(2,4-di-tert-butyl-phenyl)phosphite (Irgafos 168, marketed by CIBA-GEIGY);

4) 500 ppm of calcium stearate. Table 1 shows the properties of the polypropylene used.

B) Examples 1–6

In a LABO-30 Caccia turbo-mixer, operating at 1400 rpm the following components are blended for 4 minutes:

1) heterophasic polymer 2) 200 ppm of poly{[6-(1,1,3,3-tetramethylpiperidyl)-imine]-1,3,5-triazine-2,4-diyl][2-2,2,6,6-tetramethylpiperidyl)-amine]hexamethylene-[4-(2,2,6,6-tetramethylpiperidyl) imine]} (Chimassorb 944, marketed by CIBA-GEIGY); and 3) 350 ppm g of tris(2,4-di-tert-butyl-phenyl)phosphite (Irgafos 168, marketed by CIBA-GEIGY);

4) 500 ppm of calcium stearate;

5) Luperox 101 2,5-dimethyl-2,5-di(tert-butylperoxy) hexane (marketed by Lucidol, Pennwalt Corp. USA).

Table 2 shows the data relative to the heterophasic polymers used to prepare the polymer blends.

Once pelletized, the compositions of the heterophasic polymers differ in terms of the intrinsic viscosity values (I.V.) of the amorphous fraction (II), soluble in xylene at 25° C., of the heterophasic polymer. In order to obtain heterophasic polymers with said different values, specific quantities of Luperox 101 2,5-dimethyl-2,5-di(tert-butylperoxy) hexane have been added to the polymer (see Table 3). Table 3 also indicates the intrinsic viscosity, before and after visbreaking with the peroxide, of the amorphous fraction (II) of the heterophasic polymers that were used, which is soluble in xylene.

The compositions have been pelletized by extrusion at 210°–240° C. in a Bandera 30 extruder equipped with a 30 mm diameter screw whose length is equal to 30 diameters, has a compression ratio of 3.15, and a screen filter with 125 μm mesh. Extrusion conditions were as follows:

temperature of head filter: 220° C.;

capacity: 3.5 kg/h;

hopper atmosphere: $N_2$.

The pellets of said compositions, and the polypropylene resin, are then put in a LABO-30 Caccia mixer, and mixing for 4 minutes at 1400 rpm, in order to prepare polymer blends comprising:

1) polypropylene prepared as indicated in (A);

2) heterophasic polymer composition produced as described in (B).

The quantity of polymers present in each polymer blend prepared, the type and characteristics of the heterophasic polymer introduced, and the maximum spinning velocity obtained during the spinning carried out according to the method described in the spinnability test are shown in Table 4.

COMPARATIVE EXAMPLES 1c AND 2c

Two polymer blends are prepared and then subjected to a spinnability test as described in Examples 1–6. The only difference concerns the intrinsic viscosity of the amorphous fraction (II) of the heterophasic polymers B and C (see Table 2) which is soluble in xylene at 25° C. Table 4 shows the data relative to the comparative examples.

EXAMPLES 7–12

The polymer blends of Examples 1–6 are respectively spun to produce fibers. The spinning velocity is 1000 m/min. Said fibers are then drawn out using a draw-ratio of 1.5.

On the fibers thus obtained, having a count of 2 dtex, one evaluates the thermobonding and flexibility indexes following the methods described above. Table 5 shows the data relative to said indexes.

COMPARATIVE EXAMPLE 3 (3c)

The polypropylene resin as is used in Examples 1–6 is spun under the same conditions and using the same methods described for Examples 7–12. The results are set forth in Table 5.

COMPARATIVE EXAMPLES 13 AND 14 (13c AND 14c)

A polymer blend equal to the one described in Example 4 is spun under the same spinning conditions described in Example 3c, using the winding speed and draw ratios indicated in Table 6. In the same Table one can also find the values of the thermobonding and flexibility indexes of the fibers thus obtained.

TABLE 1

| Characteristics of the polypropylene used | |
|---|---|
| Average pellet diameter (μm) | 450 |
| Residue insoluble in xylene at 25° C. (%) | 96 |
| Melt Flow Rate (dg/min) | 12.2 |
| Intrinsic viscosity (dl/g) | 1.5 |
| Number average molecular weight ($\bar{M}n$) | 45,000 |
| Weight average molecular weight ($\bar{M}w$) | 270,000 |
| Ashes at 800° C. (ppm) | 160 |

TABLE 2

| | Fraction I ethylene/propylene | | Fraction II ethylene/propylene rubber | |
|---|---|---|---|---|
| Heterophasic polymer | Fraction[a)] | % Ethylene | Fraction[a)] | % Ethylene |
| A | 50 | 3.5 | 50 | 30 |
| B | 35 | 3.5 | 65 | 30 |
| C | 60 | 2.5 | 40 | 60 |

[a)]parts by weight

TABLE 3

| Heterophasic polymers | I.V.[a)] (dl/g) | Luperox 101 added (ppm) | I.V.[a)] (dl/g) |
|---|---|---|---|
| A | 2.25 | 0 | 2.25 |
| A1 | 2.25 | 100 | 1.60 |
| B | 3.15 | 0 | 3.15 |
| B1 | 3.15 | 100 | 2.20 |
| B2 | 3.15 | 200 | 1.90 |
| B3 | 3.15 | 1200 | 1.30 |
| C | 2.70 | 0 | 2.70 |
| C1 | 2.70 | 600 | 1.50 |

[a)]I.V.: intrinsic viscosity of the portion of the heterophasic polymer soluble in xylene at 25° C.

TABLE 4

| Examples & comparative examples | Heterophasic polymer | Polymer (1) (g) | Heterophasic polymer (g) | I.V. of amorphous fraction (dl/g) | Maximum spinning velocity (m/min) |
|---|---|---|---|---|---|
| 1 | A | 4000 | 1000 | 2.25 | 2700 |
| 2 | A1 | 4000 | 1000 | 1.60 | 3000 |
| 1c | B | 4000 | 1000 | 3.15 | 500 |
| 3 | B1 | 3500 | 1500 | 2.20 | 2700 |
| 4 | B2 | 4000 | 1000 | 1.90 | 3600 |
| 5 | B3 | 4000 | 1000 | 1.30 | 3000 |
| 2c | C | 4500 | 500 | 1.50 | 500 |
| 6 | C1 | 4500 | 500 | 1.50 | 2400 |

TABLE 5

| | | Thermobonding index | | |
|---|---|---|---|---|
| Example n. | Blend of example n. | in N at 150° C. | T(°C.) at 5 N | Flexibility index |
| 7 | 1 | 6.8 | 145 | 1040 |
| 8 | 2 | 6.6 | 146 | 1060 |
| 9 | 3 | 8.5 | 140 | 1300 |
| 10 | 4 | 8.4 | 140 | 1100 |
| 11 | 5 | 5.0 | 150 | 1200 |
| 12 | 6 | 6.1 | 145 | 1120 |
| 3c | resin | 5.0 | — | 800 |

TABLE 6

| | | | Indexes of | | |
|---|---|---|---|---|---|
| | | | Thermobonding | | |
| Compar. example n. | Winding speed (m/min) | Draw ratio | in N at 150° C. | T(°C.) at 5 N | flexibility |
| 13c | 750 | 2.0 | 4.0 | 155 | 1010 |
| 14c | 500 | 3.0 | 3.0 | 157 | 890 |

Other features, advantages and embodiments of the invention disclosed herein will be readily apparent to those exercising ordinary skill after reading the foregoing disclosure. In this regard, while specific embodiments of the invention have been described in considerable detail, variations and modifications of these embodiments can be effected without departing from the spirit and scope of the invention as described and claimed.

We claim:

1. A drawn, polyolefin fiber suitable for nonwoven fabrics, the composition of said fiber comprising an olefin polymer blend consisting essentially of (all parts and %s being by weight):

1) 50 to 80 parts of a crystalline polymer selected from the group consisting of a propylene homopolymer having an isotactic index greater than 90, and a random copolymer of propylene and an olefin selected from the group consisting of ethylene and $C_4$–$C_8$ α-olefins, said olefin being 0.05 to 15% of the copolymer; and 2) 20 to 50 parts of a heterophasic polyolefin composition comprising:

a) 20 to 70 parts of a propylene polymer of the group consisting of a propylene homopolymer and a random copolymer of propylene and an olefin selected from the group consisting of ethylene and $C_4$–$C_8$ α-olefins, said olefin being 0.5 to 10% of the copolymer of this group; and b) 30 to 80 parts of a copolymer of ethylene and an olefin selected from the group consisting of propylene and $C_4$–$C_8$ α-olefins, said copolymer being soluble in xylene at 25° C., the intrinsic viscosity of said copolymer, when its ethylene content is 40 to 70% of the copolymer, being lower than or equal to 1.5 dl/g, and, when its ethylene content is less than 40% of the copolymer, being lower than or equal to 2.3 dl/g;

said fiber having been obtained by spinning said olefin polymer blend in a spinning apparatus with real or equivalent output hole diameter of less than 0.5 mm, and then drawing the resulting fiber out with a draw-ratio from 1.1 to 1.8.

2. The fiber of claim 1, wherein the resulting fiber was drawn out with a draw ratio from 1.1 to 1.5.

3. The fiber of claim 1, wherein the ethylene copolymer of b) contains 40 to 70% of ethylene.

4. The fiber of claim 1, wherein the ethylene copolymer of b) contains less than 40% of ethylene.

5. A process for the production of a polyolefin fiber suitable for nonwoven fabrics, said process comprising spinning a fiber from an olefin polymer blend in a spinning apparatus with real or equivalent output hole diameter of less than 0.5 mm, and then drawing the resulting fiber out with a draw-ratio of 1.1 to 1.8, said olefin polymer blend comprising (all parts and %s being by weight):

1) 50 to 80 parts of a crystalline polymer selected from the group consisting of a propylene homopolymer having an isotactic index greater than 90, and a random copolymer of propylene and an olefin selected from the group consisting of ethylene and $C_4$–$C_8$ α-olefins, said olefin being 0.05 to 15% of the copolymer; and 2) 20 to 50 parts of a heterophasic polyolefin composition comprising:

a) 20 to 70 parts of a propylene polymer of the group consisting of a propylene homopolymer and a random copolymer of propylene and an olefin selected from the group consisting of ethylene and $C_4$–$C_8$ α-olefins, said olefin being 0.5 to 10% of the copolymer of this group; and b) 30 to 80 parts of a copolymer of ethylene and an olefin selected from the group consisting of propylene and $C_4$–$C_8$ α-olefins, said copolymer being soluble in xylene at 25° C., the intrinsic viscosity of said copolymer, when its ethylene content is 40 to 70% of the copolymer, being lower than or equal to 1.5 dl/g, and, when its ethylene content is less than 40% of the copolymer, being lower than or equal to 2.3 dl/g.

6. A process for the production of nonwoven fabrics, wherein fibers according to claim 1 are subjected to thermobonding.

7. Nonwoven fabrics obtained by the process of claim 6.

8. The fiber of claim 1, wherein said heterophasic polyolefin composition also has 2 to 40 parts of an essentially linear, crystalline copolymer of ethylene and said olefin, which copolymer is insoluble in xylene at ambient temperature.

9. The process of claim 5 in which said heterophasic polyolefin composition also has 2 to 40 parts of an essentially linear, crystalline copolymer of ethylene and said olefin, which copolymer is insoluble in xylene at ambient temperature.

* * * * *